US005246173A

United States Patent [19]

Steidl

[11] Patent Number: 5,246,173

[45] Date of Patent: Sep. 21, 1993

[54] VIBRATING STIRRED BALL MILL

[75] Inventor: Dieter Steidl, Hofheim am Taunus, Fed. Rep. of Germany

[73] Assignee: Hoechst Aktiengesellschaft, Frankfurt am Main, Fed. Rep. of Germany

[21] Appl. No.: 981,619

[22] Filed: Nov. 25, 1992

Related U.S. Application Data

[63] Continuation of Ser. No. 882,757, May 11, 1992, which is a continuation of Ser. No. 591,715, Oct. 2, 1990, abandoned.

[30] Foreign Application Priority Data

Oct. 4, 1989 [DE] Fed. Rep. of Germany ..... 3933097

[51] Int. Cl.[5] ..... B02C 17/24

[52] U.S. Cl. ..... 241/30; 241/172

[58] Field of Search ..... 241/30, 172, 175

[56] References Cited

U.S. PATENT DOCUMENTS

| | | |
|---|---|---|
| 2,069,164 | 1/1937 | Vogel-Jorgensen . |
| 2,613,036 | 10/1952 | Robinson . |
| 2,713,976 | 7/1955 | Youngnickel . |
| 2,789,773 | 4/1957 | Stauber . |
| 4,095,753 | 6/1978 | Ohno . |
| 4,779,809 | 10/1988 | Miwa . |

FOREIGN PATENT DOCUMENTS

| | | |
|---|---|---|
| 1254001 | 11/1967 | Fed. Rep. of Germany . |
| 2323446 | 4/1977 | France . |
| 1116980 | 6/1968 | United Kingdom . |

*Primary Examiner*—Mark Rosenbaum
*Assistant Examiner*—Frances Chin
*Attorney, Agent, or Firm*—Curtis, Morris & Safford

[57] ABSTRACT

In a vibrating stirred ball mill, a stirred ball mill is mounted on a bearing which is provided with an eccentric drive. The stirrer is connected to the stirrer drive via an articulated shaft.

18 Claims, 1 Drawing Sheet

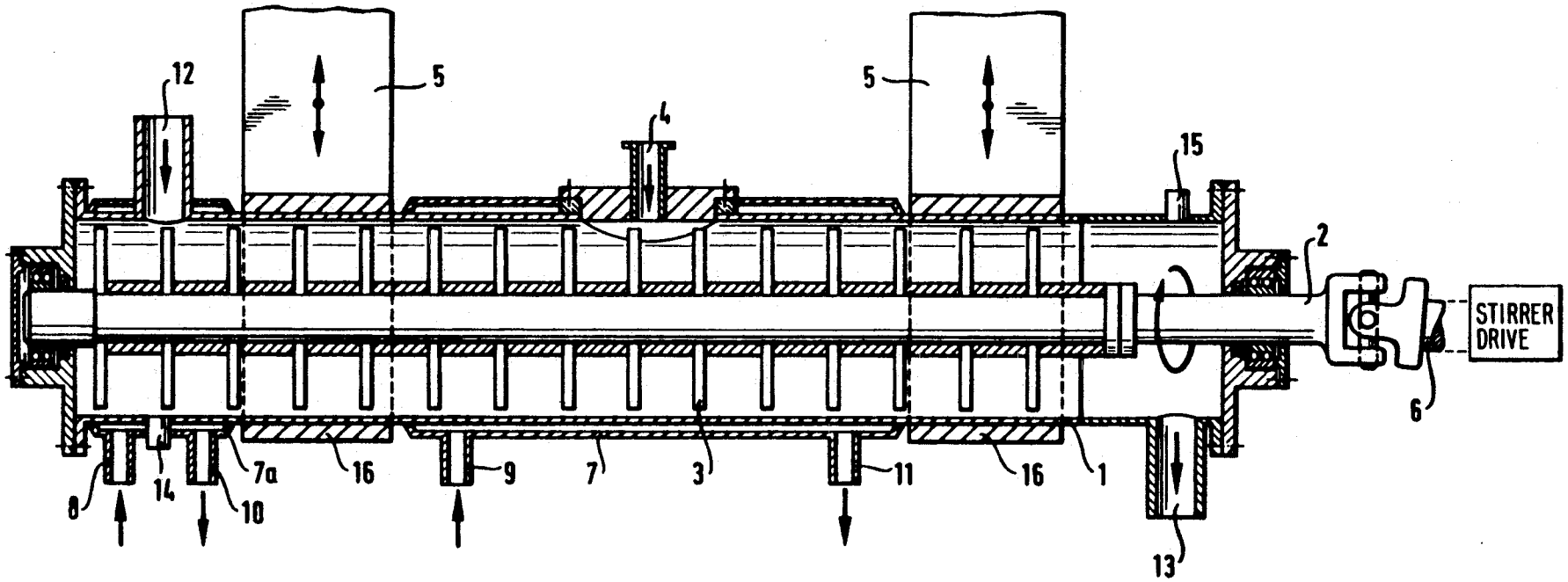
STIRRER DRIVE
6
2
15
13
1
16
5
11
3
4
7
9
5
16
7a
10
12
14
8

VIBRATING STIRRED BALL MILL

CROSS REFERENCE TO RELATED APPLICATIONS

This application is a continuation of application Ser. No. 07/882,757, filed May 11, 1992, which in turn is a continuation of application Ser. No. 07/591,715, filed Oct. 2, 1990, now abandoned.

The invention relates to a stirred ball mill, whose grinding system additionally executes a vibrating motion.

Vibrating mills and stirred ball mills are known as comminution systems. Disadvantages of both systems are the relatively large dead zones which impair the fineness of grinding and the space-time yields. The invention is intended to remedy this.

The invention achieves the object by means of a stirred ball mill which is mounted on a bearing provided with an eccentric drive, the stirrer being connected to the stirrer drive via a articulated shaft.

As a result of combining the two grinding systems in one installation, the previously dead grinding zones are largely activated so that of grinding degress of fineness of grinding are possible at greater space-time yields as compared with the respective individual systems.

The invention is explained in more detail below by reference to a drawing which merely illustrates one possible embodiment. The Figure shows the mill according to the invention in side view, represented diagrammatically without grinding bodies.

A stirrer shaft 2 mounted on both sides and having stirrer elements 3 is located in the grinding tube 1. The grinding bodies in loose form (not shown) are poured in via the charging branch 4. The grinding tube 1 is mounted at each end on a bearing 16 provided with an eccentric drive 5. The stirrer drive is connected to the stirrer via an articulated shaft 6, which absorbs the vibrating motion of the grinding tube 1 and of the stirrer shaft 2. Both drives can be fitted with an infinitely controllable gearbox. Suitable stirrer elements 3 are rods, disks or the like. The grinding tube 1 can be provided with double jackets 7, *7a*, to which coolants or heating media can be fed via orifices 8, 9, 10, 11, or discharged from them.

The stirred ball mill can be operated continuously or discontinuously. The product to be ground is charged dry or in a suspension via the charging orifice 12 and leaves the mill via the discharge orifice 13. 14 and 15 indicate measurement branches. As a result of the eccentric drive 5, the stirred ball mill is simultaneously operated as a vibrating mill. The amplitude of the vibration can be 4 to 12 mm at frequencies of 200 to 1500 vibrations per minute.

The advantages of the grinding device according to the invention over the known vibrating mill or the known stirred ball mill are demonstrated by reference to the tests below: three different feed products having varying $D_{50}$ grain sizes were ground in the grinding device according to the invention, namely by different operating procedures. The grain analyses were determined on a grain size measurement instrument made by Cilas, operating by the laser principle. The ground material was dispersed in water before measurement, and the dispersion was treated ultrasonically for one minute. The samples were measured in triplicate.

The test results can be seen in the Table which follows. The figures indicate the average grain size $D_{50}$ in μm, namely Column 1: unground;

Column 2: ground with pure vibrating mill operation;

Column 3: ground with pure stirred ball mill operation;

Column 4: ground with superposed stirred ball mill operation and vibrating mill operation according to the invention.

TABLE

| Feed product | 1 | 2 | 3 | 4 |
|---|---|---|---|---|
| Limestone | 100 | 5.0 | 3.5 | 2.0 |
| Benzoxazole | 16.9 | 5.1 | 4.4 | 2.7 |
| Polyacrylonitrile | 42.0 | 36.3 | 37.2 | 24.5 |

From the Table above, the average grain size of the product from employing the invention is about 2 percent, or about 16 percent, or about 58 percent of the average grain size of the feed ($[2/100)\times 100=2\%$; $[2.7/16.9]\times 100\approx 16\%$; $[24.5/42]\times 100\approx 58\%$).

What is claimed is:

1. A method for reducing average grain size of a feed comprising:

charging said feed to a vibrating stirred ball mill comprising:

a grinding tube having a first end and a second end, said grinding tube mounted at each end on a bearing provided with an eccentric drive, a stirrer shaft having stirrer elements positioned within said grinding tube, and stirrer drive means for driving said stirrer shaft being operatively connected to said stirrer shaft via an articulated shaft, wherein said grinding tube and stirrer simultaneously vibrate; and grinding said feed by operation of the vibrating stirred ball mill.

2. The method of claim 1 wherein the grinding tube and stirrer vibrate at an amplitude of 4 to 12 mm and a frequency of 200 to 1500 vibration per minute.

3. The method of claim 1 wherein the stirrer shaft has a first end and a second end and is mounted within the grinding tube at each end.

4. The method of claim 1 wherein the feed is charged dry.

5. The method of claim 1 wherein the feed is charged in a suspension.

6. The method of claim 1 further comprising recovering product from the vibrating stirred ball mill.

7. The method of claim 6 wherein the feed and product each have an average grain size ($D_{50}$); and, the average grain size of the product is about 2 percent of the average grain size of the feed.

8. The method of claim 7 wherein the feed is limestone.

9. The method of claim 6 wherein the feed and product each have an average grain size ($D_{50}$); and, the average grain size of the product is about 16 percent of the average grain size of the feed.

10. The method of claim 9 wherein the feed is benzoxazole.

11. The method of claim 6 wherein the feed and product each have an average grain size ($D_{50}$); and, the average grain size of the product is about 58 percent of the average grain size of the feed.

12. The method of claim 11 wherein the feed is polyacrylonitrile.

13. A vibrating stirred ball mill comprising a grinding tube having a first end and a second end, said grinding tube mounted at each end of a bearing provided with an eccentric drive, a stirrer shaft having stirrer elements positioned within said grinding tube. and stirrer drive means for driving said stirrer shaft being operatively connected to said stirrer shaft via an articulated shaft wherein said grinding tube and said stirrer simultaneously vibrate.

14. The vibrating stirred ball mill of claim 13 wherein the grinding tube and stirrer vibrate at an amplitude of 4 to 12 mm and a frequency of 200 to 1500 vibrations per minute.

15. The vibrating stirred ball mill of claim 13 wherein the stirrer shaft has a first end and a second end and is mounted within the grinding tube at each end.

16. An apparatus for reducing dead grinding zones in a stirred ball mill, said apparatus comprising a vibrating stirred ball mill comprising:

a grinding tube having a first end and a second end, said grinding tube mounted at each end on a bearing provided with an eccentric drive, a stirrer shaft having stirrer elements positioned within said grinding tube, and stirrer drive means for driving said stirrer shaft being operatively connected to said stirrer shaft via an articulated shaft, wherein said grinding tube and said stirrer simultaneously vibrate.

17. The apparatus of claim 16 wherein the grinding tube and stirrer vibrate at an amplitude of 4 to 12 mm and a frequency of 200 to 1500 vibrations per minute.

18. The apparatus of claim 16 wherein the stirrer shaft has a first end and a second end and is mounted within the grinding tube at each end.

* * * * *